US011241904B2

(12) United States Patent
Yu

(10) Patent No.: US 11,241,904 B2
(45) Date of Patent: Feb. 8, 2022

(54) RETRACTABLE PEN

(71) Applicant: Hangzhou Jianyi Technology Co., Ltd., Zhejiang (CN)

(72) Inventor: Chengpeng Yu, Zhejiang (CN)

(73) Assignee: Hangzhou Bingqi Technology Co., Ltd., Hangzhou (CN)

( * ) Notice: Subject to any disclaimer, the term of this patent is extended or adjusted under 35 U.S.C. 154(b) by 168 days.

(21) Appl. No.: 16/734,313

(22) Filed: Jan. 4, 2020

(65) Prior Publication Data

US 2021/0016596 A1 Jan. 21, 2021

(30) Foreign Application Priority Data

Jul. 15, 2019 (CN) ..... 201910637329.1

(51) Int. Cl.
*B43K 24/08* (2006.01)

(52) U.S. Cl.
CPC ..... *B43K 24/084* (2013.01)

(58) Field of Classification Search
CPC ..... B43K 24/084; B43K 5/16; B43K 5/005; B43K 7/12; B43K 7/005; B43K 8/003; B43K 21/006; B43K 8/24; B43K 24/026; B43K 24/04; B43K 24/06; B43K 24/086; B43K 24/146
See application file for complete search history.

(56) References Cited

U.S. PATENT DOCUMENTS 420,033 A * 1/1890 Bohren ..... B43K 27/02 401/20
2,671,354 A * 3/1954 Goos ..... B43K 24/086 74/503
2,905,147 A * 9/1959 Johmann ..... B43K 24/084 401/103
2,972,980 A * 2/1961 MacDonald ..... B43K 24/086 401/110
3,084,670 A * 4/1963 Dottlinger ..... B43K 24/086 401/111
3,100,403 A * 8/1963 Dottlinger ..... G05G 7/08 74/503
3,137,276 A * 6/1964 Weisser ..... B43K 24/084 401/111
3,302,619 A * 2/1967 Schodterer ..... B43K 24/086 401/110
3,334,615 A * 8/1967 Bross ..... B43K 24/084 401/110
3,814,524 A * 6/1974 Sperti ..... B43K 21/20 401/57

(Continued)

*Primary Examiner* — Patrick M. Buechner

(57) ABSTRACT

A retractable pen including a first barrel, an ink cartridge, a second barrel, a clamping component and a spring; a main body of the ink cartridge, the spring and the clamping component are all located inside the first barrel and the second barrel, the spring is wound on a portion, close to the nib, of the ink cartridge, and the nib in a portion of the ink cartridge can be extended and exposed out of the first barrel; a mounting portion, muff-coupled to the first barrel, is arranged on the clamping component, and the clamping component is rotatable with respect to the first barrel; when the first barrel is muff-coupled to the second barrel, a polygonal neck is formed on a surface where an outer surface of the clamping component comes into contact with the second barrel.

7 Claims, 9 Drawing Sheets

(56) References Cited

U.S. PATENT DOCUMENTS

| | | | | |
|---|---|---|---|---|
| 4,943,175 | A * | 7/1990 | Heim | B43K 24/084 401/111 |
| 6,832,868 | B2 * | 12/2004 | Hertwig | B43K 24/086 401/112 |
| 2004/0190973 | A1 * | 9/2004 | Nakayama | B43L 19/0018 401/6 |
| 2021/0023871 | A1 * | 1/2021 | Yu | B43K 5/005 |

* cited by examiner

RETRACTABLE PEN

CROSS-REFERENCE TO RELATED APPLICATIONS

This application claims the benefit of priority from Chinese Patent Application No. CN201910637329.1, filed on Jul. 15, 2019. The content of the aforementioned application, including any intervening amendments thereto, is incorporated herein by reference in its entirety.

TECHNICAL FIELD

The present invention relates to stationery and in particular to a retractable pen.

BACKGROUND OF THE PRESENT INVENTION

Writing instruments are indispensable tools in daily work and life, among which the most commonly used are click pens that can be operated with a single hand and used conveniently. However, the existing click pens are complicated in structure. When writing with a click pen, the button of the click pen is only pressed by changing the gesture of holding the click pen, to control the exposure and retraction of the ink cartridge. In some cases, it is inconvenient for users if they cannot switch the state of the pen quickly.

Furthermore, due to technical prejudice, it is difficult to improve the existing click pens and the technical operators are weary of making improvement thereto. Actually, the existing click pens are instable in structure, the detached accessories are easily lost, and the assembly process is hard. Moreover, the large amount of parts results in especially high production cost. Due to this reason, pens with a cap have high market share due to their low cost. For those pens with a cap, the loss of cap has become a problem.

In addition, when a click pen is put in a bag, briefcase and pocket, the button of the click pen may be inevitably pressed, causing the ink cartridge of the pen to be exposed to the paper in the briefcase, the lining of the bag and the pocket. This will be troublesome.

SUMMARY OF THE PRESENT INVENTION

A purpose of the present invention is to provide a handheld retractable pen that can be operated quickly by a single hand without changing the gesture of holding the pen when writing with it.

For this purpose, the following technical solution is employed in the present invention.

A retractable pen is provided, comprising a first barrel, an ink cartridge, a second barrel, a clamping component and a spring; a main body of the ink cartridge, the spring and the clamping component are all located inside the first barrel and the second barrel, the spring is wound on a portion, close to the nib, of the ink cartridge, and the nib in a front portion of the ink cartridge can be extended and exposed out of the first barrel; a mounting portion, muff-coupled to the first barrel, is arranged on the clamping component, and the clamping component is rotatable with respect to the first barrel; when the first barrel is muff-coupled to the second barrel, a polygonal neck is formed on a surface where an outer surface of the clamping component comes into contact with the second barrel, and a limiting stopper is arranged in the polygonal neck; extension bars equally spaced in circumferential direction are arranged in the front portion of the second barrel, and the extension bars are all extended outward in a length direction and enclosed to form a cylindrical shape; ribs, matched with the extension bars, are arranged on the periphery of the front portion of the first barrel, and the adjacent ribs are clamped between adjacent extension bars so that the first barrel and the second barrel are limited to do relative movement in the length direction; a bulge is arranged on an inner sidewall of the second barrel, and the bulge is received in the polygonal neck and cannot get out of the polygonal neck; when the second barrel and the first barrel do relative movement in a length direction, the bulge can slide around the limiting stopper within the polygonal neck; the limiting stopper is located in a middle region of the polygonal neck, and the bulge is clamped into the limiting stopper when the second barrel and the first barrel do relative movement in the length direction; the ink cartridge is exposed in a first stage in which the second barrel and the first barrel approach each other in the length direction; and the nib is hidden in a second stage in which the bulge is separated from the limiting stopper and the second barrel and the first barrel get away from each other in the length direction.

Preferably, the second barrel comprises a barrel main body and a rear-barrel front portion, with an installation portion connected to the rear-barrel front portion being arranged at a front end of the barrel main body; the rear-barrel front portion comprises extension bars and a barrel root portion connected to the extension bars; and the installation portion is muff-coupled to the barrel root portion in a rotatable manner.

Preferably, a locking slot is formed in a rear portion of the first barrel, and corresponding to the locking slot, a locking catch is arranged on an inner wall of the barrel main body of the second barrel; the locking slot comprises an installation guide slot, an anti-rotation straight slot, a locking guide slot, a locking clamp slot and a compression-specific straight slot; starting from the rear portion of the first barrel forward, the installation guide slot, the anti-rotation straight slot, the locking guide slot and the compression-specific straight slot are successively communicated from back to front;

the locking clamp slot is in a circumferential direction and deviated from the anti-rotation straight slot and the compression-specific straight slot; and the locking clamp slot is connected to the anti-rotation straight slot or the compression-specific straight slot by a wall of the locking guide slot to guide the rotation of the locking catch;

in the second stage in which the bulge is separated from the limiting stopper and the second barrel and the first barrel get away from each other in the length direction, that is, when the ink cartridge is hidden, the locking catch is located in the anti-rotation straight slot.

Preferably, the installation guide slot looks like a horn that has a large rear side and a small front side, a front end of the installation guide slot is communicated with the anti-rotation straight slot, and a front end of the anti-rotation straight slot is communicated with the locking guide slot; the locking guide slot is enclosed by a first inclined guide wall connecting the anti-rotation straight slot with the locking clamp slot and a second inclined guide wall connecting the locking clamp slot with a rear end of the compression-specific straight slot.

Preferably, the polygonal neck is located on an outer sidewall in the middle of the clamping component, and the limiting stopper is located in a middle region of the polygonal neck, so that the bulge is received in a guide groove structure between a polygonal inner wall of the polygonal neck and an outer wall of the limiting stopper and can move therein;

the guide groove structure comprises a first guide slide on which the bulge moves, a first guide slope, a second guide slide, a second guide slope, a third guide slide and a returning guide slope;

the first guide slide, the first guide slope, the second guide slide, the second guide slope, the third guide slide and the returning guide slope are successively connected end to end, and a tail end of the returning guide slope is connected to the first guide slide;

the limiting stopper comprises a first limiting slope corresponding to the second guide slide and a stopping bayonet in which the bulge is received and which causes the nib of the ink cartridge to be exposed; and the stopping bayonet axially corresponds to the middle portion of the second guide slope;

An installation guide slot communicated with a rear end of the clamping component is formed at a starting position of the first guide slide of the polygonal neck, the installation guide slot is a horn-like guide slot having a large rear side and a small front side, a stopping step is formed on the installation guide slot and located in a front inner end portion of the horn-like guide slot.

Preferably, a mounting portion having an outer diameter less than that of the main body of the clamping component is arranged at a rear end of the clamping component, and the mounting portion comprises an annular installation groove and an installation ring located on a rear side of the installation groove; an annular installation structure, corresponding to the installation groove, is arranged on an inner wall of a rear end of the first barrel 1.

Preferably, an outer sidewall of a rear portion of the first barrel has a same diameter as the outer sidewall of the clamping component.

Compared with the prior art, with the use of the above technical solutions, the present invention has the following beneficial effects.

1. When writing with the handheld retractable pen of the present invention, the pen can be operated quickly by a single hand without changing the gesture of holding the pen, so it is convenient to use. The fitting of the extension bars with the ribs increases the friction and makes the user feel better when touching the pen, and increases the holding area of the front barrel so that it is convenient to hold the pen.

2. Compared with conventional pens with a cap, the handheld retractable pen of the present invention has no split components such as caps. The structure is simple, and the loss of caps is avoided.

3. Compared with conventional click pens, the front barrel and the rear barrel serve as the clicking portions of the handheld retractable pen of the present invention, instead of the clicking button. Accidental operation is avoided. Moreover, with the introduction of the locking slot in the preferred solution, when the ink cartridge is hidden, the hidden state of the ink cartridge can be locked by rotating and locking the ink cartridge by manual operation. Thus, when the retractable pen is put in a briefcase, it will not stain or scratch objects in the briefcase even if it is accidentally clicked by an external force.

DETAILED DESCRIPTION OF THE PRESENT INVENTION

Figure 1:
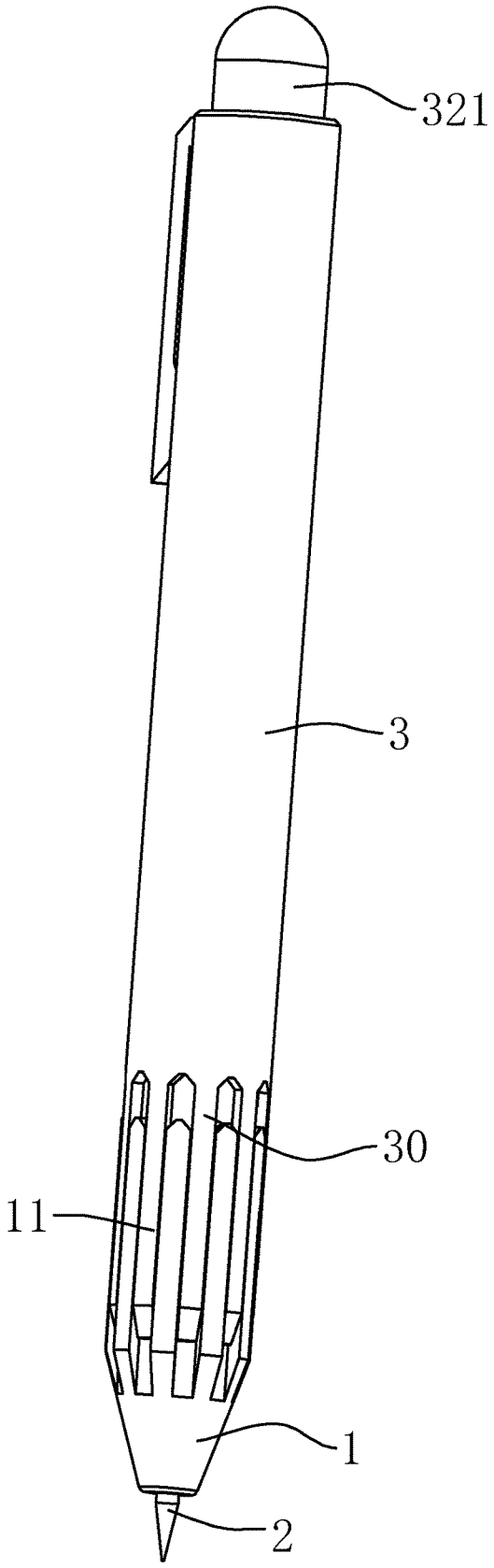
FIG. 1 is a stereoscopic structure diagram of Embodiment 1 of the present invention.
Figure 2:
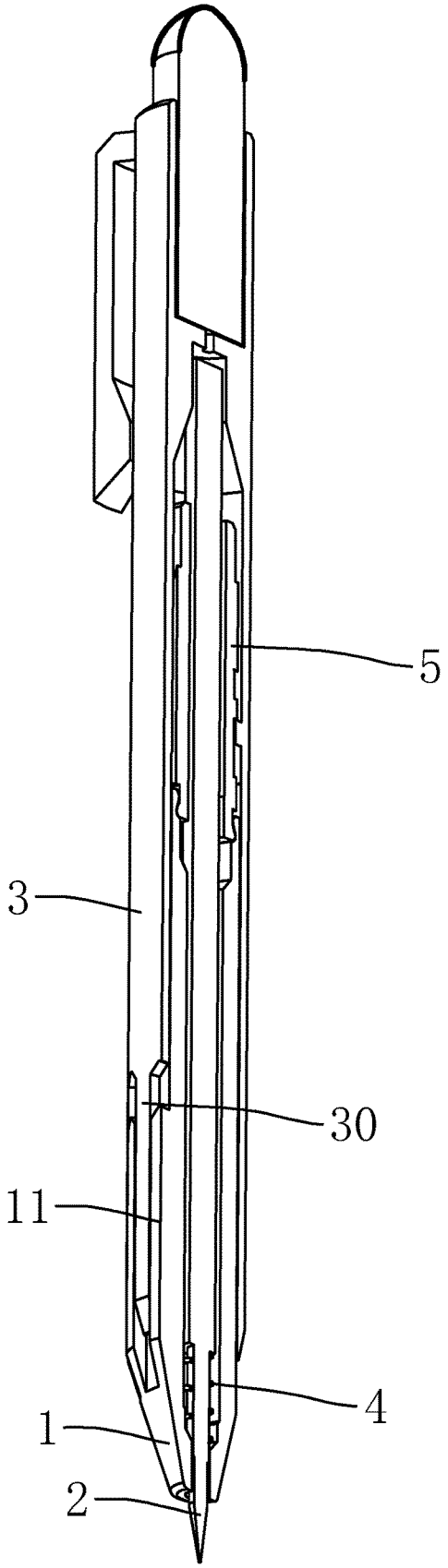
FIG. 2 is a stereoscopic sectional view of Embodiment 1 of the present invention.
Figure 3:
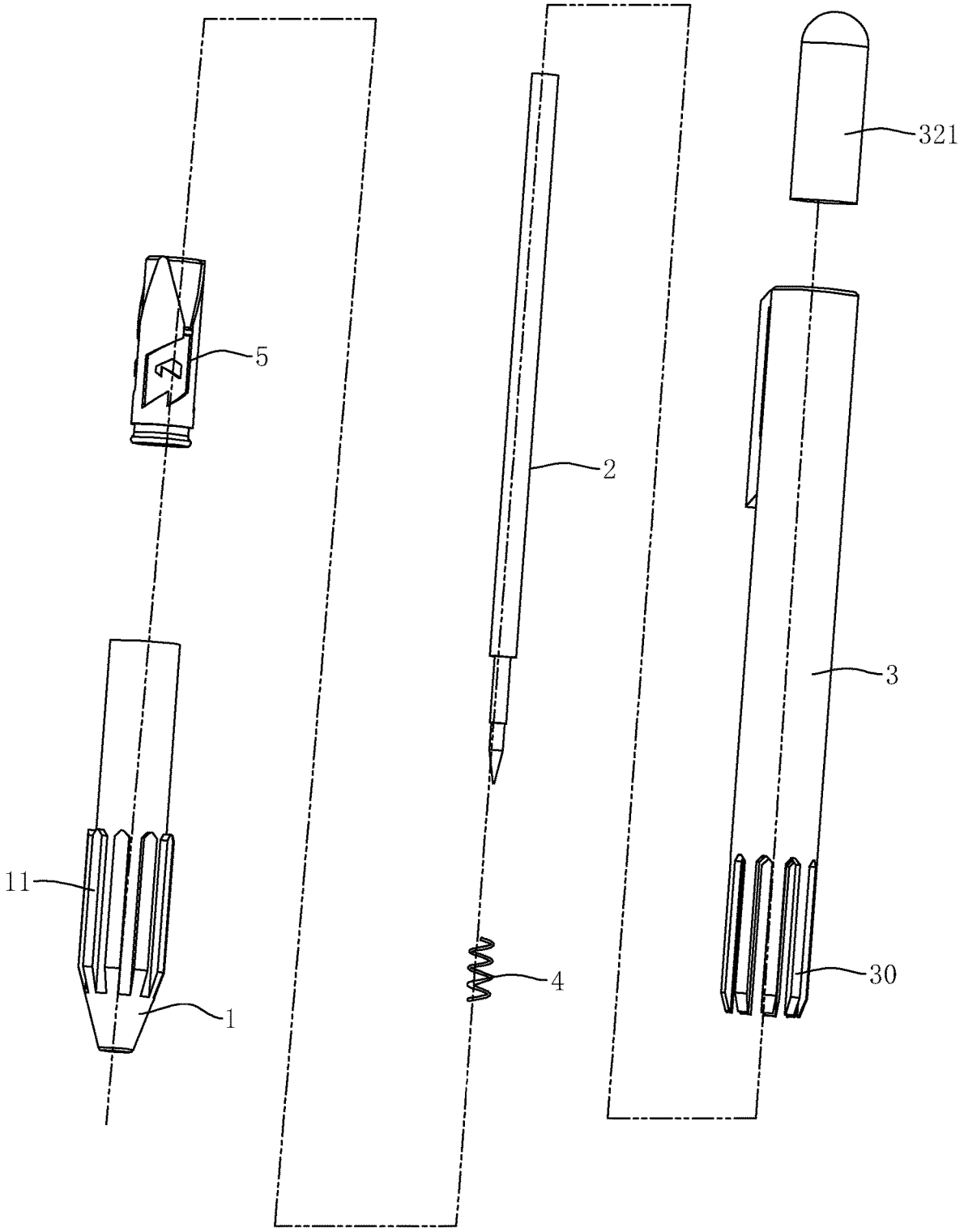
FIG. 3 is an exploded installation view of Embodiment 1 of the present invention.
Figure 4:
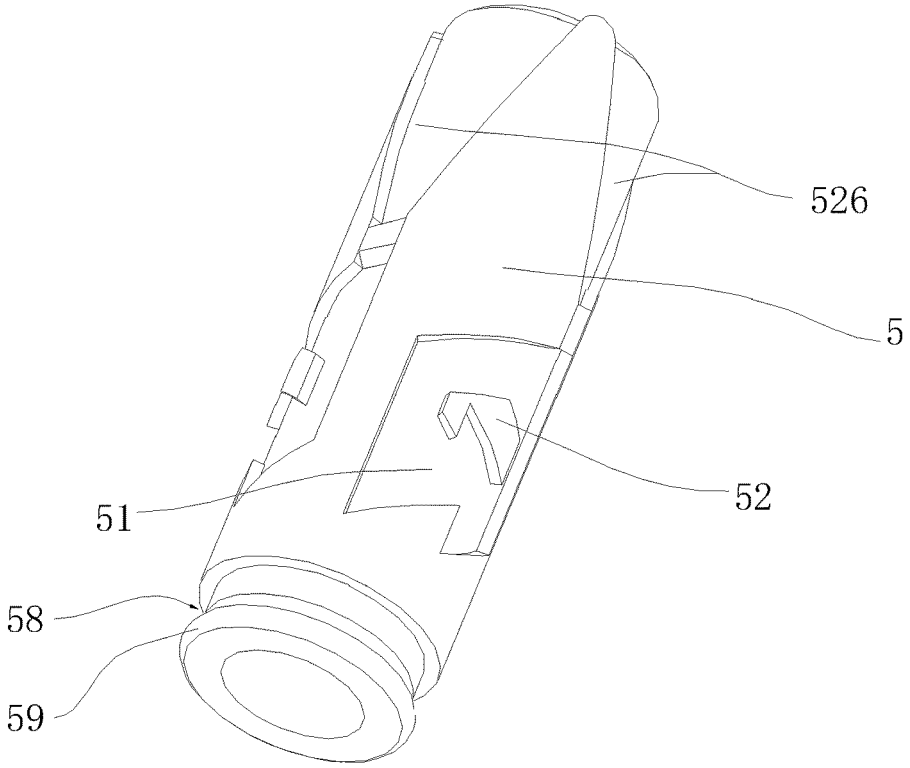
FIG. 4 is a stereoscopic structure diagram of a clamping component.

The following description is provided to disclose the present invention so that a person of ordinary skill in the art can implement the present invention. Preferred embodiments to be described are merely exemplary, and a person of ordinary skill in the art may conceive of other apparent variants. The fundamental principles of the present invention defined in the following description are applicable to other implementations, variants, improvements, equivalents and other technical solutions with departing from the spirit and scope of the present invention.

It should be understood that, in the disclosure of the present invention, orientations or positional relationships indicated by terms "longitudinal", "transverse", "upper", "lower", "front", "rear", "left", "right", "vertical", "horizontal", "top", "bottom", "inner", "outer" and the like are the orientations and the positional relationships illustrated on the basis of the accompanying drawings, merely used for ease of describing the present invention and simplifying the description, rather than indicating or implying that the stated devices or elements must have a specific orientation or must be constructed and operated in a specific orientation. Thus, those terms shall not be interpreted as any limitation to the present invention.

In the present invention, the term "a" or "an" as used in the claims and description shall be interpreted as "one or more". That is, for a certain element, there may be one element in one embodiment, while there may be several elements in other embodiments. The term "a" or "an" shall not be interpreted as being unique or singular, unless the number of the element is explicitly indicated in the disclosure of the present invention. The term "a" or "an" shall not be interpreted as any limitation to the number.

The present invention will be further described below with reference to the accompanying drawings.

Embodiment 1

A retractable pen as shown in FIGS. 1-6 comprises a first barrel 1, an ink cartridge 2, a second barrel 3, a clamping component 5 and a spring 4; a main body of the ink cartridge 2, the spring 4 and the clamping component 5 are all located inside the first barrel 1 and the second barrel 3, the spring 4 is wound on a portion, close to the nib, of the ink cartridge 2, and the nib in a front portion of the ink cartridge 2 can be extended and exposed out of the first barrel 1.

A mounting portion, muff-coupled to the first barrel 1, is arranged on the clamping component 5, and the clamping component 5 is rotatable with respect to the first barrel 1. Specifically, the clamping component 5 is overall cylindrical, a mounting portion having an outer diameter less than that of the main body of the clamping component is arranged at a rear end of the clamping component 5, and the mounting portion comprises an annular installation groove 58 and an installation ring 59 located on a rear side of the installation groove 58. An annular installation structure, corresponding to the installation groove 58, is arranged on an inner wall of a rear end of the first barrel 1. By the muff-coupling, the clamping component 5 is rotatable with respect to the first barrel 1.

When the first barrel 1 is muff-coupled to the second barrel 3, the rear portion of the first barrel 1 has a same diameter as the outer sidewall of the clamping component 5. The clamping component 5 is entirely located in the second barrel 3. A polygonal neck 51 is formed on a surface where an outer surface of the clamping component 5 comes into contact with the second barrel 3. A limiting stopper 52 is arranged in the polygonal neck 51. The first barrel 1 has an outer diameter less than that of the front portion of the second barrel. The front portion of the second barrel 3 covers, as a sleeve, the first barrel 1. A muff-coupling spacing, by which the second barrel 3 and the first barrel 1 can move by a certain stroke in relative to each other, is formed between a step of the first barrel 1 and a connecting ring of the second barrel 3. By the muff-coupling spacing, the first barrel 1 and the second barrel 3 can do relative movement in the length direction, so that they can move by a distance when the pen is retracted or clicked.

Extension bars 30 are arranged in the front portion of the second barrel 3, and the extension bars 30 are all extended outward in a length direction and enclosed to form a cylindrical shape; and ribs 11, matched with the extension bars 30, are arranged on the periphery of the front portion of the first barrel 1, and the adjacent ribs 11 are clamped between adjacent extension bars 30 so that the first barrel 1 and the second barrel 3 are limited to do relative movement in the length direction.

It is intended to include the following way of fitting the polygonal neck 51, the limiting stopper 52 and the bulge 31 in the present invention: the limiting stopper 52 is located in a middle region of the polygonal neck 51, and the bulge 31 is clamped into the limiting stopper 52 when the second barrel 3 and the first barrel 1 do relative movement in the length direction, and the ink cartridge 2 is exposed in a first stage in which the second barrel 3 and the first barrel 1 approach each other in the length direction. The nib 2 is hidden in a second stage in which the bulge 31 is separated from the limiting stopper 52 and the second barrel 3 and the first barrel 1 get away from each other in the length direction. It is to be included in the scope of the present invention as long as the limiting stopper 52 is located in the polygonal neck 51 so that the bulge 31 has the above two states. For a person of ordinary skill in the art, it is possible that the bulge 31 is clamped into the limiting stopper 52 in a first stage in which the second barrel 3 and the first barrel 1 approach each other in the length direction, and the bulge 31 is separated from the limiting stopper 52 to return to the original position in the second stage in which the second barrel 3 and the first barrel 1 get away from each other in the length direction. This implementation is one of many implementations that may be rationally derived by a person of ordinary skill in the art from the above description. A specific structure will be exemplified below.

In a specific implementation, the first structure of the polygonal neck 51, the limiting stopper 52 and the bulge 31 is as follows:

the polygonal neck 51 is located on an outer sidewall in the middle of the clamping component 5, and the limiting stopper 52 is located in a middle region of the polygonal neck 51, so that the bulge 31 is received in a guide groove structure between a polygonal inner wall of the polygonal neck 51 and an outer wall of the limiting stopper 52 and can move therein.

The guide groove structure comprises a first guide slide 51*a* on which the bulge 31 moves, a first guide slope 51*b*, a second guide slide 51*c*, a second guide slope 51*d*, a third guide slide 51*e* and a returning guide slope 51*f*. The first guide slide 51*a*, the first guide slope 51*b*, the second guide slide 51*c*, the second guide slope 51*d*, the third guide slide 51*e* and the returning guide slope 51*f* are successively connected end to end, and a tail end of the returning guide slope 51*f* is connected to the first guide slide 51*a*.

The limiting stopper 52 comprises a first limiting slope 52*a* corresponding to the second guide slide 51*c* and a stopping bayonet 52*b* in which the bulge 31 is received and which causes the nib of the ink cartridge to be exposed; and the stopping bayonet 52*b* axially corresponds to the middle portion of the second guide slope 51*d*.

Figure 5:
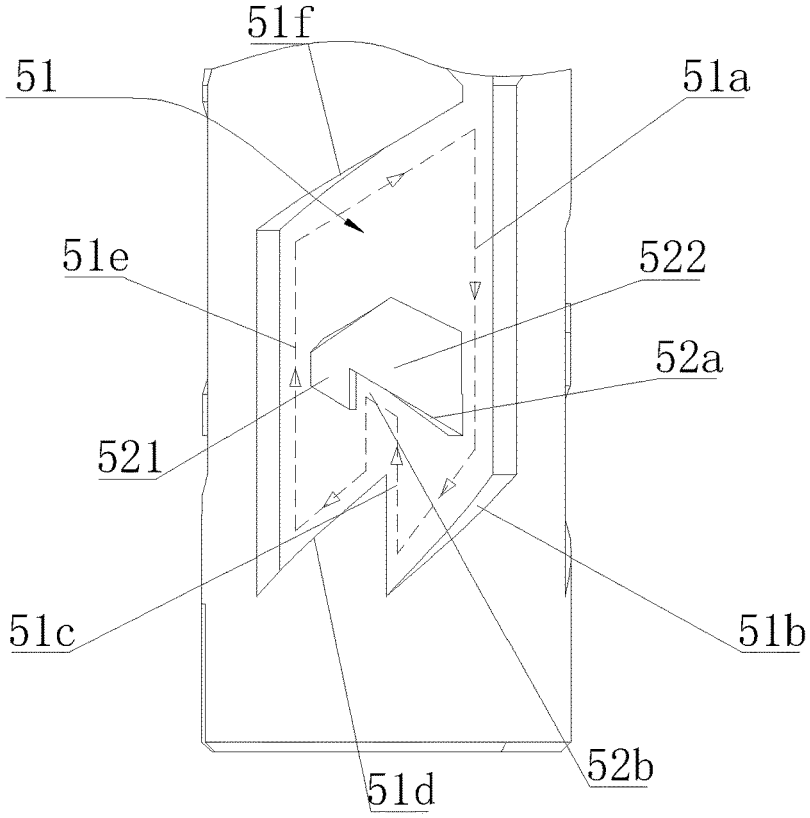
FIG. 5 is a schematic view of a slide path of the clamping component and the bulge in Embodiment 1 of the present invention.
Figure 6:
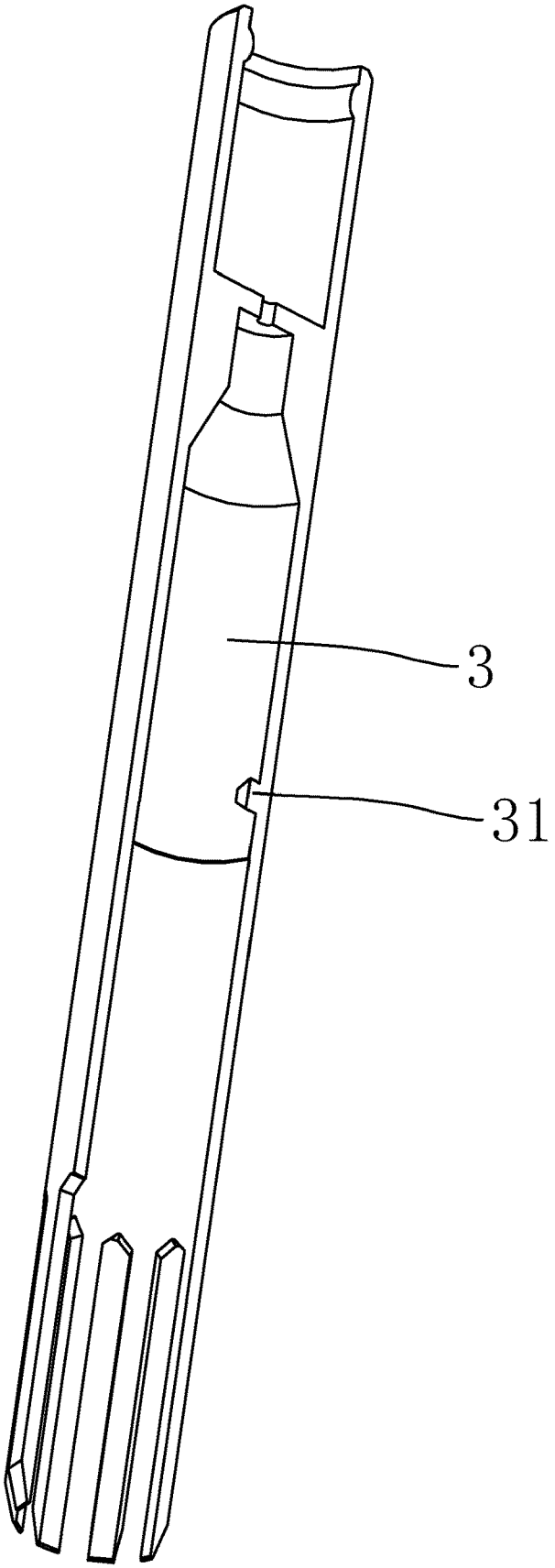
FIG. 6 is a structure diagram of the bulge in the second barrel.
Figure 7:
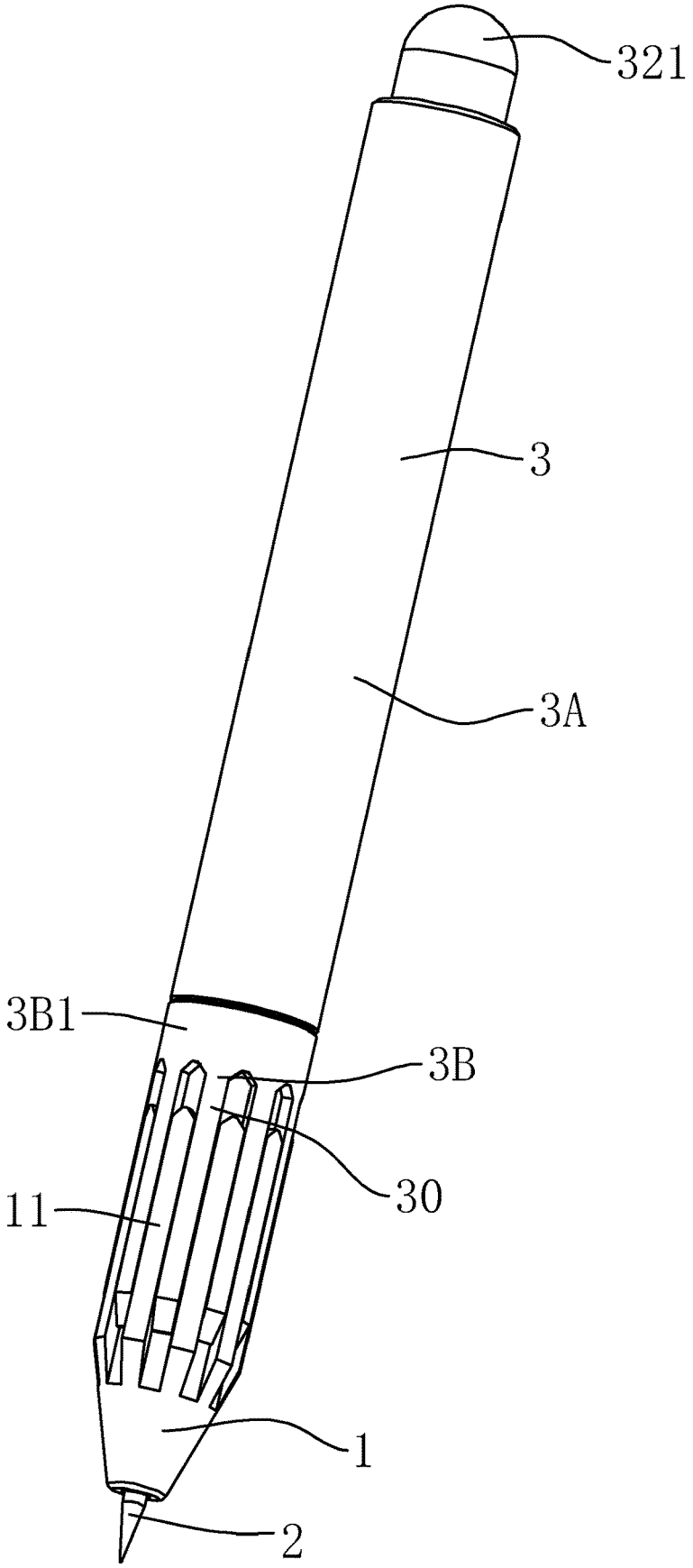
FIG. 7 is a stereoscopic semi-sectional view of Embodiment 2 of the present invention.
Figure 8:
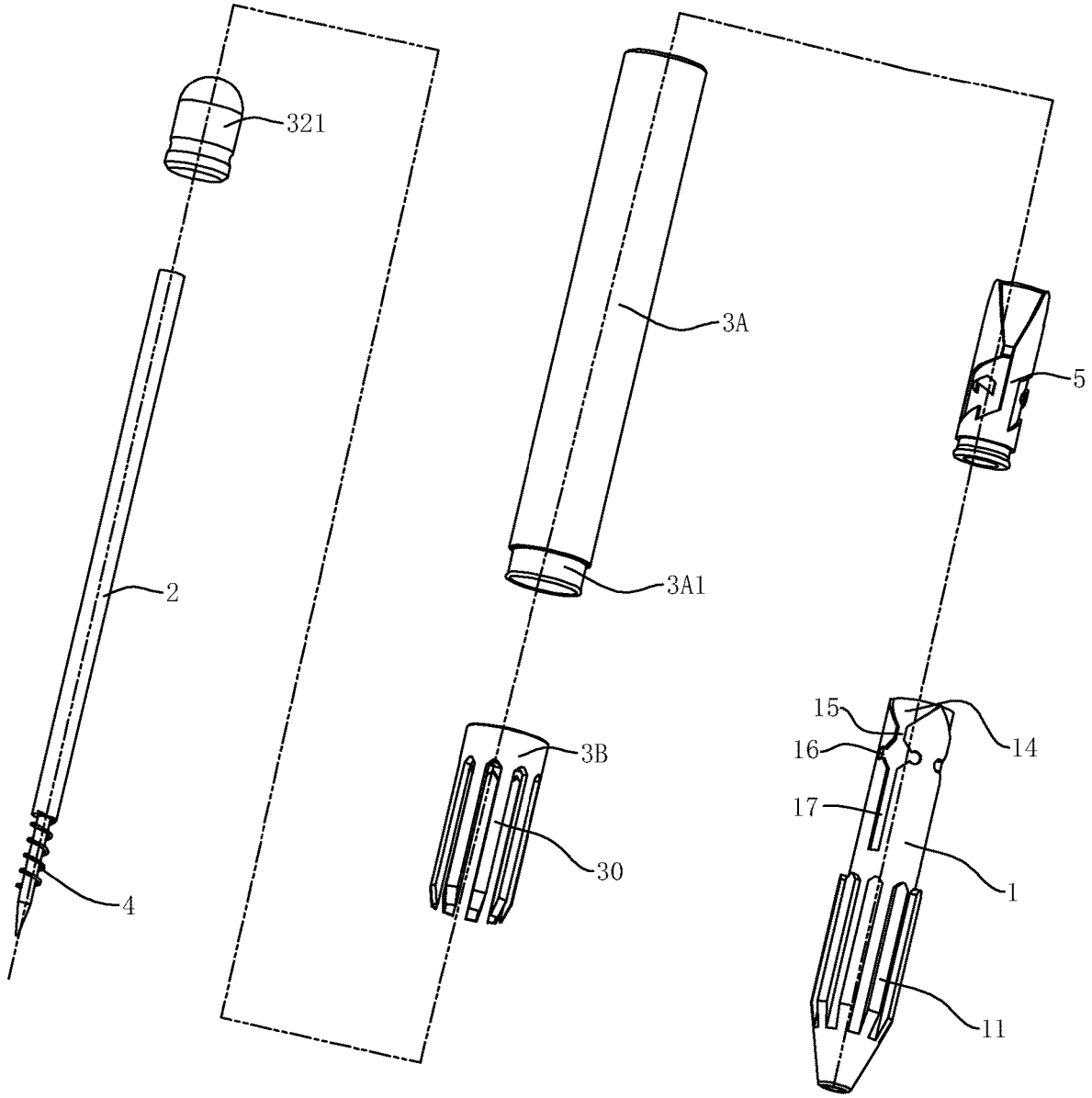
FIG. 8 is an exploded installation view of Embodiment 2 of the present invention.
Figure 9:
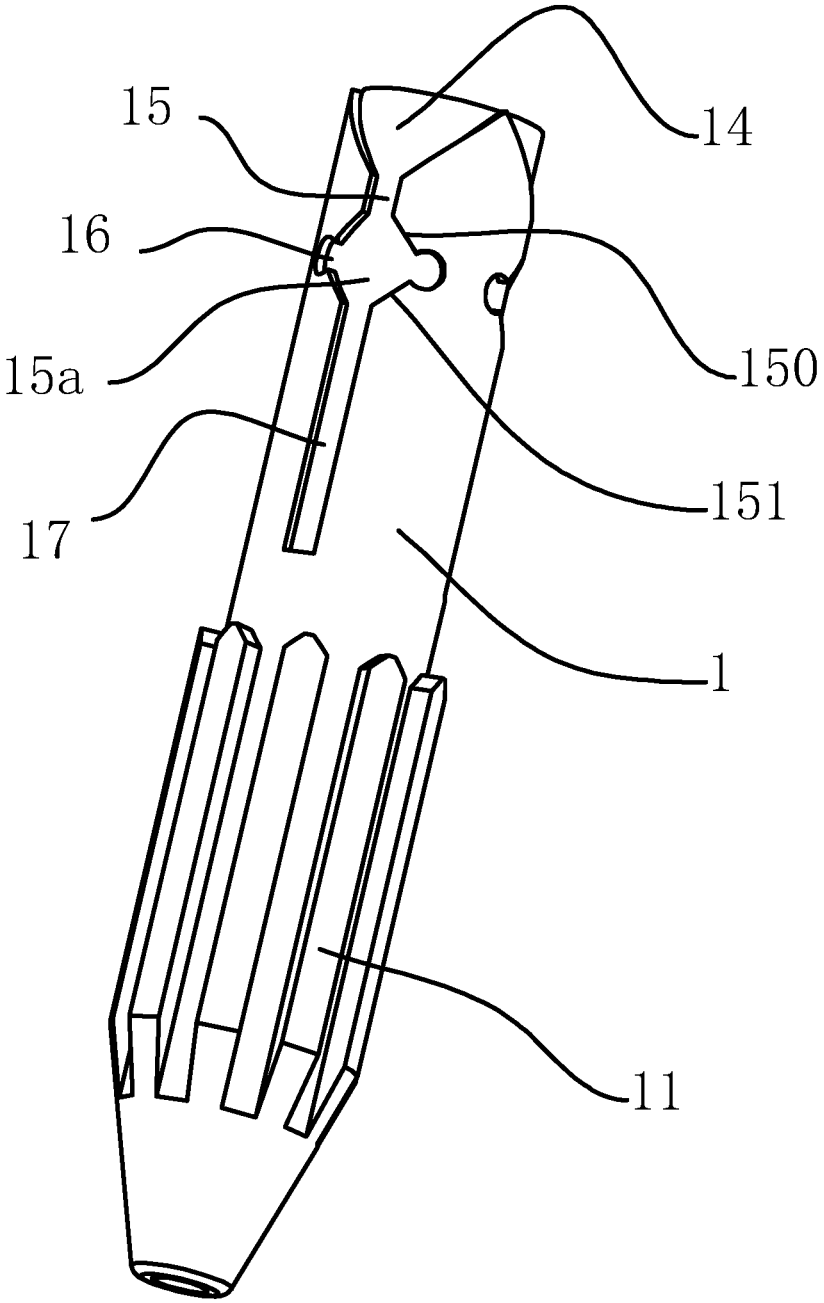
FIG. 9 is a stereoscopic structure diagram of the first barrel in Embodiment 2.
Figure 10:
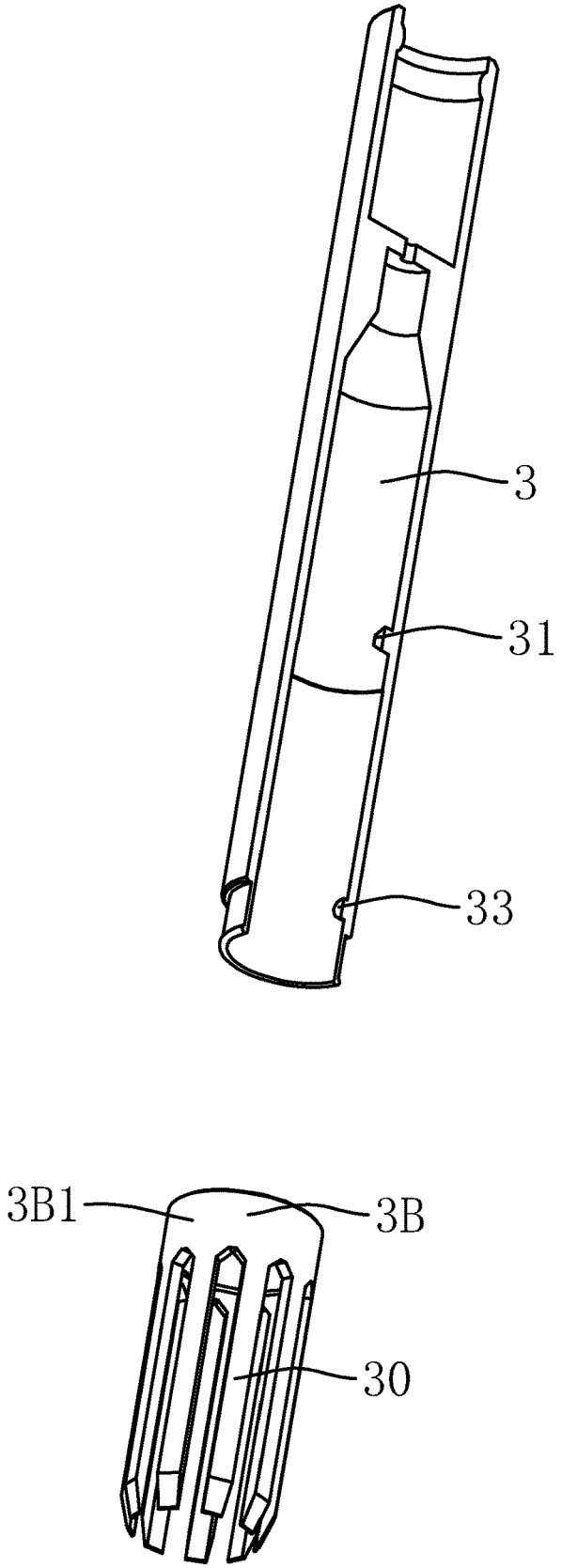
FIG. 10 is an exploded structure diagram of the second barrel in Embodiment 2.

As shown by the dotted line in FIG. 5, when the second barrel 3 is compressed with regard to the clamping component 5, the bulge 31 moves along the first guide slide 51*a*, starting from its initial position, and up to the end along the first guide slope 51*b*. Then, the clamping component 5 rotates, until the bulge 31 is located at the tail end of the first guide slope 51*b*. This is the first time that the second barrel 3 is compressed with regard to the clamping component 5 to the maximum stroke. The second barrel 3 rebounds after being released; the bulge 31 returns along the second guide slide 51*c*; and because of the first limiting slope 52*a*, the clamping component 5 rotates again, so that the bulge 31 is clamped in the stopping bayonet 52*b*. Then, the nib of the ink cartridge is exposed to an appropriate position. When the second barrel 3 is compressed with regard to the clamping component 5 for the second time, the clamping component 5 rotates so that the bulge 31 moves along the second guide slope. The second barrel 3 rebounds after being released; the bulge 31 moves along the third guide slide, until the clamping component 5 convolutes because of the returning guide slope; and the bulge 31 returns to the initial position and the ink cartridge 2 is hidden. The advancing depends upon the relative movement of the second barrel 1 and the second barrel 2 by pushing them by a single hand; and the returning depends upon the elasticity of the spring 4.

Further, in terms of the shape and structure, the limiting stopper 52 consists of a first limiting member 521 and a second limiting member 522, both of which are stripped bulges having two parallel sides, with one end of the first limiting member 521 being connected to one end of the second limiting member 522 to form a 7-shaped stopping step; an acute angle is formed between the first limiting member 521 and the second limiting member 522, and the region surrounded by the acute angle is the stopping bayonet 52*b*. The polygonal neck 51 is a polygonal groove formed by overlapping two parallelograms which are different in size and the extended lines of two adjacent sides of which are coincided.

Embodiment 2

As shown in FIGS. 7-10, different from Embodiment 1, the second barrel 3 comprises a barrel main body 3A and a rear-barrel front portion 3B, with an installation portion 3A1 connected to the rear-barrel front portion 3B being arranged at a front end of the barrel main body 3A; the rear-barrel front portion 3B comprises extension bars 30 and a barrel root portion 3B1 connected to the extension bars 30; and the installation portion is muff-coupled to the barrel root portion 3B1 in a rotatable manner.

Additionally, different from Embodiment 1, a locking slot is formed in a rear portion of the first barrel 1, and corresponding to the locking slot, a locking catch 33 is arranged on an inner wall of the barrel main body of the second barrel 3; the locking slot comprises an installation guide slot 14, an anti-rotation straight slot 15, a locking guide slot 15*a*, a locking clamp slot 16 and a compression-specific straight slot 17; starting from the rear portion of the first barrel 1 forward, the installation guide slot 14, the anti-rotation straight slot 15, the locking guide slot and the compression-specific straight slot 17 are successively communicated from back to front. The locking clamp slot 16 is in a circumferential direction and deviated from the anti-rotation straight slot 15 and the compression-specific straight slot 17. The locking clamp slot 16 is connected to the anti-rotation straight slot 15 or the compression-specific straight slot 17 by a wall of the locking guide slot 15*a* to guide the rotation of the locking catch 33. In the second stage in which the bulge 31 is separated from the limiting stopper 52 and the second barrel 3 and the first barrel 1 get away from each other in the length direction, that is, when the ink cartridge 2 is hidden, the locking catch 33 is located in the anti-rotation straight slot 15. With the introduction of the locking slot, when the ink cartridge is hidden, the hidden state of the ink cartridge can be locked by rotating the ink cartridge, so that the exposure of the nib because of an external force is avoided.

Further, the installation guide slot 14 looks like a horn that has a large rear side and a small front side, a front end of the installation guide slot 14 is communicated with the anti-rotation straight slot 15, and a front end of the anti-rotation straight slot 15 is communicated with the locking guide slot 15*a*; the locking guide slot 15*a* is enclosed by a first inclined guide wall 150 connecting the anti-rotation straight slot 15 with the locking clamp slot 16 and a second inclined guide wall 151 connecting the locking clamp slot 16 with a rear end of the compression-specific straight slot 17. More specifically, each locking slot set comprises one installation guide slot 14, one anti-rotation straight slot 15, two locking guide slots 15*a*, two locking clamp slots 16 and one compression-specific straight slot 17; and the two locking clamp slots are deviated from each other and are respectively on two sides of the anti-rotation straight slot 15 and the compression-specific straight slot 17, with one locking guide slot 15*a* and one locking clamp slot 16 distributed on each side.

In the second stage in which the bulge 31 is separated from the limiting stopper 52 and the second barrel 3 and the first barrel 1 get away from each other in the length direction, that is, when the ink cartridge 2 is hidden, the locking catch 33 is exactly located in the anti-rotation straight slot 15.

With the introduction of the locking slot, when the ink cartridge 2 is hidden, the exposure of the ink cartridge 2 because of an external force is avoided. Thus, when the retractable pen is put in a briefcase, it will not stain or scratch the lining of the briefcase even if an external force is applied to the pen. Specifically, by slightly pressing the first barrel 1 by the user, the locking catch 33 gets out of the anti-rotation straight slot 15 and enters the locking guide slot 15*a*. In the locking guide slot 15*a*, by rotating in any way, the locking catch 33 will be guided into the locking clamp slot 16 by the first inclined guide wall 150 or the second inclined guide wall 151. When the locking catch 33 is guided into the locking clamp slot 16, it is clamped and will not get out of the locking clamp slot if no rotating force is applied thereto. Therefore, the expansion/retraction length between the second barrel 3 and the first barrel 1 is locked mechanically in the length direction. The uncertainty of the elasticity of the spring 4 is overcome, only small change is made to the structure, the manual operation is simple, the cost of parts and materials is not increased, and more beneficial effects are realized.

A rotary member 321 is arranged at a rear end of the second barrel 3. An eraser is arranged in the rear portion of the rotary member 321. The circumference of the rotary member 321 may be connected to the pen in a rotary manner, by an annular groove and an annular ring arranged on an inner side of the rear end of the second barrel 3. The remaining structure is the same as Embodiment 1.

What described above are preferred implementations of the present invention. It should be noted that, for a person of ordinary skill in the art, a number of variants and improvements may be made without departing from the principle of the present invention, and those variants and improvements shall also be regarded as falling into the protection scope of the present invention.

It will be apparent to those skilled in the art that the present invention is not limited to the details of the above-mentioned exemplary embodiments, and that the present invention can be implemented in other specific forms without departing from the spirit or basic features of the present invention. Therefore, the embodiments are to be regarded as exemplary and non-limiting in every respect, and the scope of the present invention is defined by the appended claims rather than the above description. Therefore, it is intended to encompass, in the present invention, all changes that fall into the meaning and scope of equivalents of the claims. Any reference numbers in the claims shall not be construed as limiting the claims involved.

In addition, it should be understood that, although the description has been described by implementations, not every implementation includes only one independent technical solution. This narration of the description is for clarity only, and those skilled in the art shall take the description as a whole. The technical solutions in the embodiments may be appropriately combined to form other implementations that may be understood by those skilled in the art.

What is claimed is:

1. A retractable pen, comprising a first barrel (1), an ink cartridge (2), a second barrel (3), a clamping component (5) and a spring (4); a main body of the ink cartridge (2), the spring (4) and the clamping component (5) are all located inside the first barrel (1) and the second barrel (3); the spring (4) is wound on a portion, close to a nib, of the ink cartridge (2), and the nib can be extended and exposed out of the first barrel (1);

a mounting portion, muff-coupled to the first barrel (1), is arranged on the clamping component (5), and the clamping component (5) is rotatable with respect to the first barrel (1);

when the first barrel (1) is muff-coupled to the second barrel (3), a polygonal neck (51) is formed on a surface where an outer surface of the clamping component (5) comes into contact with the second barrel (3), and a limiting stopper (52) is arranged in the polygonal neck (51);

extension bars (30) equally spaced in circumferential direction are arranged in a portion of the second barrel (3), and the extension bars (30) are all extended outward in a length direction and enclosed to form a cylindrical shape; and ribs (11), matched with the extension bars (30), are arranged on a periphery of a portion of the first barrel (1), and adjacent ribs (11) are clamped between adjacent extension bars (30) so that the first barrel (1) and the second barrel (3) are limited to do relative movement in the length direction;

a bulge (31) is arranged on an inner sidewall of the second barrel (3), and the bulge (31) is received in the polygonal neck (51) and cannot get out of the polygonal neck; and when the second barrel (3) and the first barrel (1) do relative movement in the length direction, the bulge (31) can slide around the limiting stopper (52) within the polygonal neck (51);

the limiting stopper (52) is located in a middle region of the polygonal neck (51), and the bulge (31) is clamped into the limiting stopper (52) when the second barrel (3) and the first barrel (1) do relative movement in the length direction; and the ink cartridge (2) is exposed in a first stage in which the second barrel (3) and the first barrel (1) approach each other in the length direction; and the nib is hidden in a second stage in which the bulge (31) is separated from the limiting stopper (52) and the second barrel (3) and the first barrel (1) get away from each other in the length direction.

2. The retractable pen according to claim 1, wherein a mounting portion having an outer diameter less than that of the main body of the clamping component (5) is arranged at a rear end of the clamping component (5), and the mounting portion comprises an annular installation groove (58) and an installation ring (59) located on a rear side of the installation groove (58); an annular installation structure, corresponding to the installation groove (12), is arranged on an inner wall of a rear end of the first barrel (1).

3. The retractable pen according to claim 1, wherein the polygonal neck (51) is located on an outer sidewall in the middle of the clamping component (5), and the limiting stopper (52) is located in a middle region of the polygonal neck (51), so that the bulge (31) is received in a guide groove structure between a polygonal inner wall of the polygonal neck (51) and an outer wall of the limiting stopper (52) and can move therein;

the guide groove structure comprises a first guide slide (51*a*) on which the bulge (31) moves, a first guide slope (51*b*), a second guide slide (51*c*), a second guide slope (51*d*), a third guide slide (51*e*) and a returning guide slope (51*f*);

the first guide slide (51*a*), the first guide slope (51*b*), the second guide slide (51*c*), the second guide slope (51*d*), the third guide slide (51*e*) and the returning guide slope (51*f*) are successively connected end to end, and a tail end of the returning guide slope (51*f*) is connected to the first guide slide (51*a*);

the limiting stopper (52) comprises a first limiting slope (52*a*) corresponding to the second guide slide (51*c*) and a stopping bayonet (52*b*) in which the bulge (31) is received and which causes the nib to be exposed; and the stopping bayonet (52*b*) axially corresponds to the middle portion of the second guide slope (51*d*); and an installation guide slot (526) communicated with a rear end of the clamping component (5) is formed at a starting position of the first guide slide (51*a*) of the polygonal neck (51), the installation guide slot (526) is a horn-like guide slot having a large rear side and a small front side, a stopping step (523) is formed on the installation guide slot and located in an inner end portion of the horn-like guide slot.

4. The retractable pen according to claim 3, wherein an outer sidewall of a rear portion of the first barrel (1) has a same diameter as the outer sidewall of the clamping component (5).

5. The retractable pen according to claim 1, wherein the second barrel (3) comprises a barrel main body (3A) and a rear-barrel front portion (3B), with an installation portion (3A1) connected to the rear-barrel front portion (3B) being arranged at an end of the barrel main body (3A); the rear-barrel front portion (3B) comprises a barrel root portion (3B1) connected to the extension bars (30); and the installation portion (3A1) is muff-coupled to the barrel root portion (3B1) in a rotatable manner.

6. The retractable pen according to claim 5, wherein a locking slot is formed in the first barrel (1), and corresponding to the locking slot, a locking catch (33) is arranged on an inner wall of the barrel main body of the second barrel (3); the locking slot comprises an installation guide slot (14), an anti-rotation straight slot (15), a locking guide slot (15*a*), a locking clamp slot (16) and a compression-specific straight slot (17); and the installation guide slot (14), the anti-rotation straight slot (15), the locking guide slot and the compression-specific straight slot (17) are successively communicated in order;

the locking clamp slot (16) is in a circumferential direction and deviated from the anti-rotation straight slot (15) and the compression-specific straight slot (17); and the locking clamp slot (16) is connected to the anti-rotation straight slot (15) or the compression-specific straight slot (17) by a wall of the locking guide slot (15*a*) to guide the rotation of the locking catch (33); and in the second stage in which the bulge (31) is separated from the limiting stopper (52) and the second barrel (3) and the first barrel (1) get away from each other in the length direction, that is, when the ink cartridge (2) is hidden, the locking catch (33) is located in the anti-rotation straight slot (15).

7. The retractable pen according to claim 6, wherein the installation guide slot (14) looks like a horn that has a large rear side and a small front side, an end of the installation guide slot (14) is communicated with the anti-rotation straight slot (15), and an end of the anti-rotation straight slot (15) is communicated with the locking guide slot (15*a*); the locking guide slot (15*a*) is enclosed by a first inclined guide wall (150) connecting the anti-rotation straight slot (15) with the locking clamp slot (16) and a second inclined guide wall (151) connecting the locking clamp slot (16) with a rear end of the compression-specific straight slot (17).

* * * * *